US011871881B2

(12) United States Patent
Van Varick et al.

(10) Patent No.: US 11,871,881 B2
(45) Date of Patent: Jan. 16, 2024

(54) DETACHABLE TOILET SEAT

(71) Applicant: CVS Pharmacy, Inc., Woonsocket, RI (US)

(72) Inventors: Robert Beale Van Varick, Yardley, PA (US); Donald Samuel Strum, Princeton, NJ (US); George Benjamin Wintner, Brooklyn, NY (US)

(73) Assignee: CVS Pharmacy, Inc., Woonsocket, RI (US)

( * ) Notice: Subject to any disclaimer, the term of this patent is extended or adjusted under 35 U.S.C. 154(b) by 200 days.

(21) Appl. No.: 17/404,656

(22) Filed: Aug. 17, 2021

(65) Prior Publication Data

US 2022/0047129 A1 Feb. 17, 2022

Related U.S. Application Data

(60) Provisional application No. 63/066,581, filed on Aug. 17, 2020.

(51) Int. Cl.
*A47K 13/00* (2006.01)

(52) U.S. Cl.
CPC ..... *A47K 13/005* (2013.01)

(58) Field of Classification Search
CPC ..... A47K 13/005; A47K 13/02
USPC ..... 4/237, 239
See application file for complete search history.

(56) References Cited

U.S. PATENT DOCUMENTS 4,477,932 A 10/1984 Lenosky
4,503,571 A 3/1985 Sidney
4,578,829 A 4/1986 Lenosky
5,027,445 A 7/1991 Locarno
5,027,472 A 7/1991 Goodman
5,191,660 A 3/1993 Francke
5,412,815 A 5/1995 Ellis
5,638,554 A 6/1997 Corzine
5,819,327 A 10/1998 Miller
6,000,068 A 12/1999 Chavis
6,052,840 A 4/2000 West et al.
6,112,339 A 9/2000 Nichols et al.
6,389,612 B1 5/2002 Harris
6,418,566 B1 7/2002 Plonta
(Continued)

FOREIGN PATENT DOCUMENTS

CN 201418711 3/2010
CN 102028426 4/2011
(Continued)

OTHER PUBLICATIONS

Notice of Allowance with English Translation for China Patent Application No. 202130819088.0, dated Mar. 30, 2022 3 pages.
(Continued)

*Primary Examiner* — Tuan N Nguyen
(74) *Attorney, Agent, or Firm* — Sheridan Ross P.C.

(57) ABSTRACT

An improved toilet seat includes an upper body includes an upper sitting surface; a lower body coupled with the upper body, where the lower body includes a lower contact surface; and at least one slideable clamp positioned between the upper sitting surface and the lower contact surface, where the at least one slideable clamp includes a clamp arm and clamp paddle coupled to the clamp arm, and where the clamp arm is configured to move between a first position and a second position.

20 Claims, 13 Drawing Sheets

(56) References Cited

U.S. PATENT DOCUMENTS

| | | | | |
|---|---|---|---|---|
| D485,337 | S | 1/2004 | Tani et al. | |
| 6,698,036 | B2 | 3/2004 | Armbruster et al. | |
| 6,857,138 | B2 | 2/2005 | Moser et al. | |
| 7,291,847 | B2 | 11/2007 | Morrison | |
| 7,552,485 | B1 | 6/2009 | Harrison, Jr. | |
| 7,712,159 | B2 | 5/2010 | Stringer et al. | |
| 8,402,572 | B2 | 3/2013 | Herasimtschuk | |
| 8,819,873 | B2 | 9/2014 | Embler | |
| 9,364,123 | B1 | 6/2016 | Mirzoev | |
| 2007/0113328 | A1 | 5/2007 | Cheng | |
| 2008/0005829 | A1 | 1/2008 | Chen | |
| 2009/0013454 | A1 | 1/2009 | Landsberger et al. | |
| 2009/0044323 | A1 | 2/2009 | Feemster | |
| 2013/0263368 | A1 | 10/2013 | Nguyen | |
| 2015/0107010 | A1 | 4/2015 | Mogan | |
| 2015/0272408 | A1 | 10/2015 | Hall | |
| 2015/0359392 | A1 | 12/2015 | Richmond et al. | |
| 2018/0263438 | A1 | 9/2018 | Verchick | |
| 2021/0000309 | A1* | 1/2021 | Wallberg ..... | A47K 13/26 |

FOREIGN PATENT DOCUMENTS

| | | |
|---|---|---|
| CN | 107260050 | 10/2017 |
| CN | 210055847 | 2/2020 |
| CN | 210114383 | 2/2020 |
| JP | 2000-300467 | 10/2000 |
| KR | 2014-0060903 | 5/2014 |
| WO | WO 03/105651 | 12/2003 |
| WO | WO 2004/045352 | 6/2004 |
| WO | WO 2010/142368 | 12/2010 |
| WO | WO 2019/188402 | 10/2019 |

OTHER PUBLICATIONS

Official Action for China Patent Application No. 202110946656.2, dated Aug. 9, 2022, 10 pages.

Official Action (with English translation) for China Patent Application No. 202110946656.2, dated Mar. 20, 2023, 13 pages.

* cited by examiner

DETACHABLE TOILET SEAT

CROSS REFERENCE TO RELATED APPLICATIONS

This application claims the benefit of and priority, under 35 U.S.C. § 119(e), to U.S. Provisional Application No. 63/066,581, filed on Aug. 17, 2020, and entitled "Detachable Toilet Seat," the entire disclosure of which is hereby incorporated herein by reference, in its entirety, for all that it teaches and for all purposes.

BACKGROUND

The present disclosure is generally directed to sanitary engineering and specifically relates to a seat that is easily attachable to and detachable from a toilet.

Toilets and toilet seats are generally standardized in their seat height. While standard seat heights accommodate a large portion of a population, there are also many people for whom a standard toilet seat height will not work. For instance, elderly persons and other individuals with a limited range of motion or motor skills may require a toilet seat that is higher than a standard toilet seat height. The raised toilet seat may be useful for a person that cannot easily move between a fully seated position and standing position without support or help from another person.

Toilet seat cushions provide the ability to raise the sitting height of a toilet seat. Unfortunately, currently available toilet seat cushions are perceived and viewed as undesirable medical devices. Additionally, certain types of toilet seat cushions either do not attach to an existing toilet seat or their attachment mechanisms are too difficult to manipulate by most users. There are many other issues associated with currently available toilet seat cushions that limit their desirability and utility.

BRIEF SUMMARY

It is with respect to the above issues and other problems that the examples presented herein were contemplated. It is an object of the present disclosure to provide an improved toilet seat or toilet seat cushion that easily connects to and disconnects from a toilet seat. It is also an object of the present disclosure to provide a toilet seat or toilet seat cushion that has an enhanced, non-medical, look as compared to conventional toilet seat cushions. It is also an object of the present disclosure to provide a toilet seat or toilet seat cushion that has an improved contour for pelvic comfort, while still providing an aesthetically pleasing design.

In one aspect, a toilet seat is provided that includes: an upper body including an upper sitting surface; a lower body coupled with the upper body, where the lower body includes a lower contact surface; and at least one slideable clamp positioned between the upper sitting surface and the lower contact surface, where the at least one slideable clamp includes a clamp arm and clamp paddle coupled to the clamp arm, wherein the clamp arm is configured to move between a first position and a second position.

Examples may include one of the following features, or any combination thereof. The first position may correspond to a position where the clamp arm is extended away from the upper body and the second position may correspond to a position where the clamp arm is more than half contained within a cavity formed between the upper body and the lower body.

The clamp paddle may contact a toilet seat when the clamp arm is in the second position. In some examples, the clamp paddle may include a clamp pad that contacts the toilet seat.

The toilet seat may further include a release button that, when pressed, causes the clamp arm to extend toward the first position. The release button may be coupled to the clamp arm by a retention spring that releases the clamp arm when the release button is pressed such that an extension spring forces the clamp arm to extend toward the first position. In some examples, the at least one slideable clamp may include a first slideable clamp and a second slideable clamp. The first slideable clamp and second slideable clamp may be configured to operate together or independently. For example, each slideable clamp may include its own clamp arm and clamp paddle and each clamp arm may be coupled to a different release button. In other examples, each clamp arm may be coupled to a common release button.

Examples may include one of the following features, or any combination thereof.

The toilet seat may include a plurality of seat grips distributed around the lower contact surface.

The toilet seat may include a front lip. The front lip may be formed as part of the upper body, but may extend beyond the lower contact surface of the lower body.

In another aspect, a toilet seat is provided that includes: A toilet seat comprising: an upper body comprising an upper sitting surface, a seat back, and a seat front, wherein the seat front has a height less than a height of the seat back; a lower body coupled with the upper body, wherein the lower body comprises a lower contact surface; one or more sidewalls extending between the upper body and the lower body; at least one slideable clamp positioned on the one or more sidewalls, wherein the at least one slideable clamp comprises a clamp arm and clamp paddle coupled to the clamp arm, and wherein the clamp arm is configured to move between a first position and a second position; and a mount configured to support the clamp arm.

The toilet seat may further include a release button that, when pressed, causes the clamp arm to extend toward the first position. The release button may be coupled to the clamp arm by a lever biased by a spring. The lever may release the clamp arm when the release button is actuated such that an extension spring forces the clamp arm to extend toward the first position. The lever may comprise an upper portion, a lower portion, and a slot disposed in the lower portion. The slot may be configured to receive the clamp arm, the lever coupled to the release button at the upper portion. Actuation of the release button may cause the slot to rotate, thereby releasing the clamp arm.

The first position may correspond to a position where the clamp arm is extended away from the upper body. The second position may correspond to a position where the clamp arm is more than half contained within a cavity formed between the upper body and the lower body. The at least one slideable clamp may be biased to the first position.

In yet another aspect, a toilet seat is provided that includes: an upper body comprising an upper sitting surface, a seat back, and a seat front, wherein the seat front has a height less than a height of the seat back; a lower body coupled with the upper body, wherein the lower body comprises a lower contact surface; one or more sidewalls extending between the upper body and the lower body; at least one slideable clamp positioned on the one or more sidewalls, wherein the at least one slideable clamp comprises a clamp arm and clamp paddle coupled to the clamp arm, and wherein the clamp arm is configured to move between a first position and a second position; a release button that, when pressed, causes the clamp arm to extend toward the first position; and a lever comprising a slot, the lever coupled to the release button and the slot receiving the clamp arm, the lever biased by a spring to lock the lever against the clamp arm and to release the clamp arm when the release button is actuated.

The preceding is a simplified summary of the disclosure to provide an understanding of some aspects of the disclosure. This summary is neither an extensive nor exhaustive overview of the disclosure and its various aspects, examples, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, examples, and configurations of the disclosure are possible utilizing, alone or in combination, one or more of the features set forth above or described in detail below. All examples and features mentioned above can be combined in any technically possible way.

Additional features and advantages are described herein and will be apparent from the following Detailed Description and the figures.

DETAILED DESCRIPTION

Before any examples of the disclosure are explained in detail, it is to be understood that the disclosure is not limited in its application to the details of construction and the arrangement of components set forth in the following description or illustrated in the following drawings. The disclosure is capable of other examples and of being practiced or of being carried out in various ways.

Also, it will be appreciated that the claims of the instant application are not limited to the ornamental design of the various articles and examples shown in the accompanying figures. Moreover, the figures are not intended to illustrate the only available ornamental design of the various articles and examples described herein. As can be appreciated by a person having ordinary skill in the art, any number of alternative design options are available for the disclosed articles that could achieve the same functionality as described and/or claimed herein.

Further, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Referring now to FIGS. 1-5, various components and configurations of a toilet seat 100 will be described in accordance with at least some examples of the present disclosure. The illustrated toilet seat 100 may also be referred to as a toilet seat cushion or portable toilet seat. As will be appreciated, the toilet seat 100 may be configured to operatively cooperate with another seat (e.g., a toilet) or device designed to support a person in a sitting position. The toilet seat 100 may be provided to raise a sitting height of another seat, such as a toilet, when the toilet seat 100 is resting on top of the other seat.

Figure 1A:
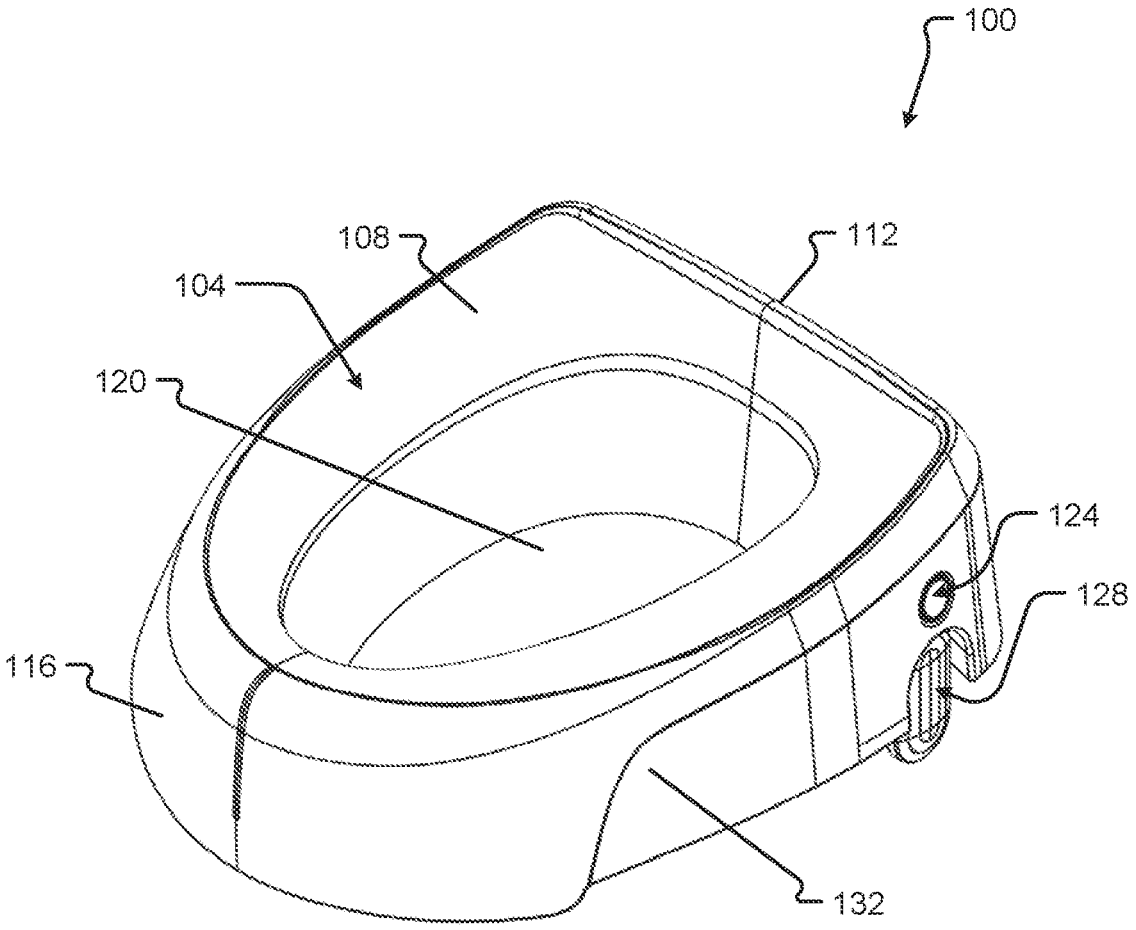
FIG. 1A is a top perspective view of a toilet seat in accordance with examples of the present disclosure.
Figure 1B:
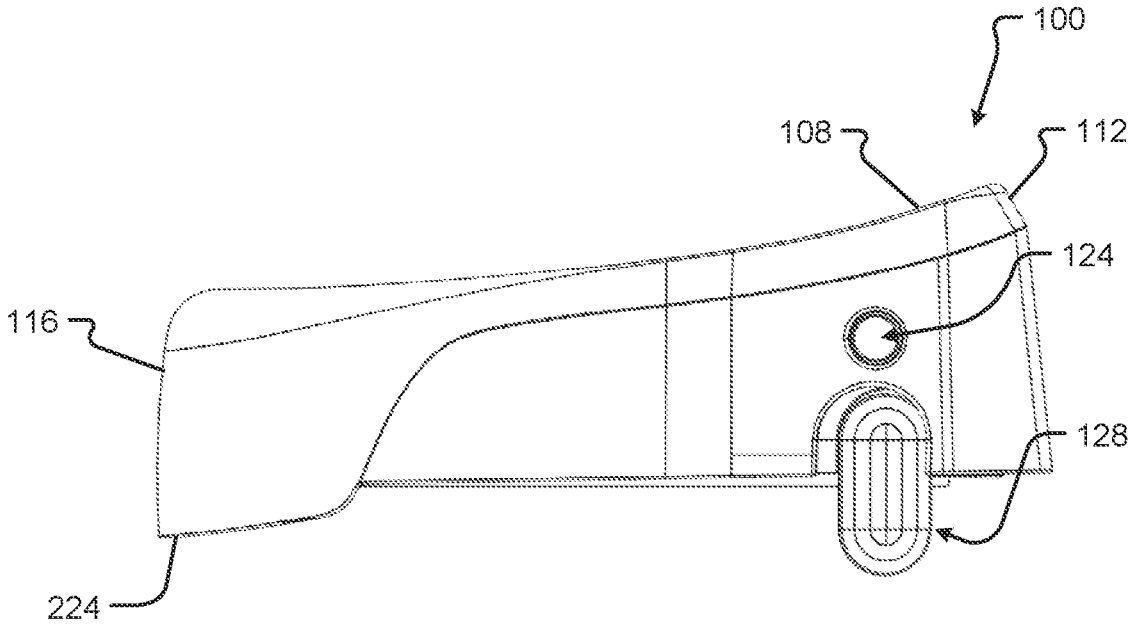
FIG. 1B is a side view of a toilet seat in accordance with examples of the present disclosure.

Turning to FIGS. 1A and 1B, a perspective view and a side view of the toilet seat 100 are shown, respectively. The toilet seat 100 includes an upper body 104, which may include an upper sitting surface 108, a seat front 116, a seat back 112, and one or more sidewalls 132. The one or more sidewalls 132 are shown and described below in a particular configuration (or shown to have a particular configuration or shape), however, it should be appreciated that this is one of many possible configurations or shapes. The sidewall(s) 132 of the upper body 104 may be contoured as depicted or may flow substantially continuously from the seat front 116 to the seat back 112.

Figure 5:
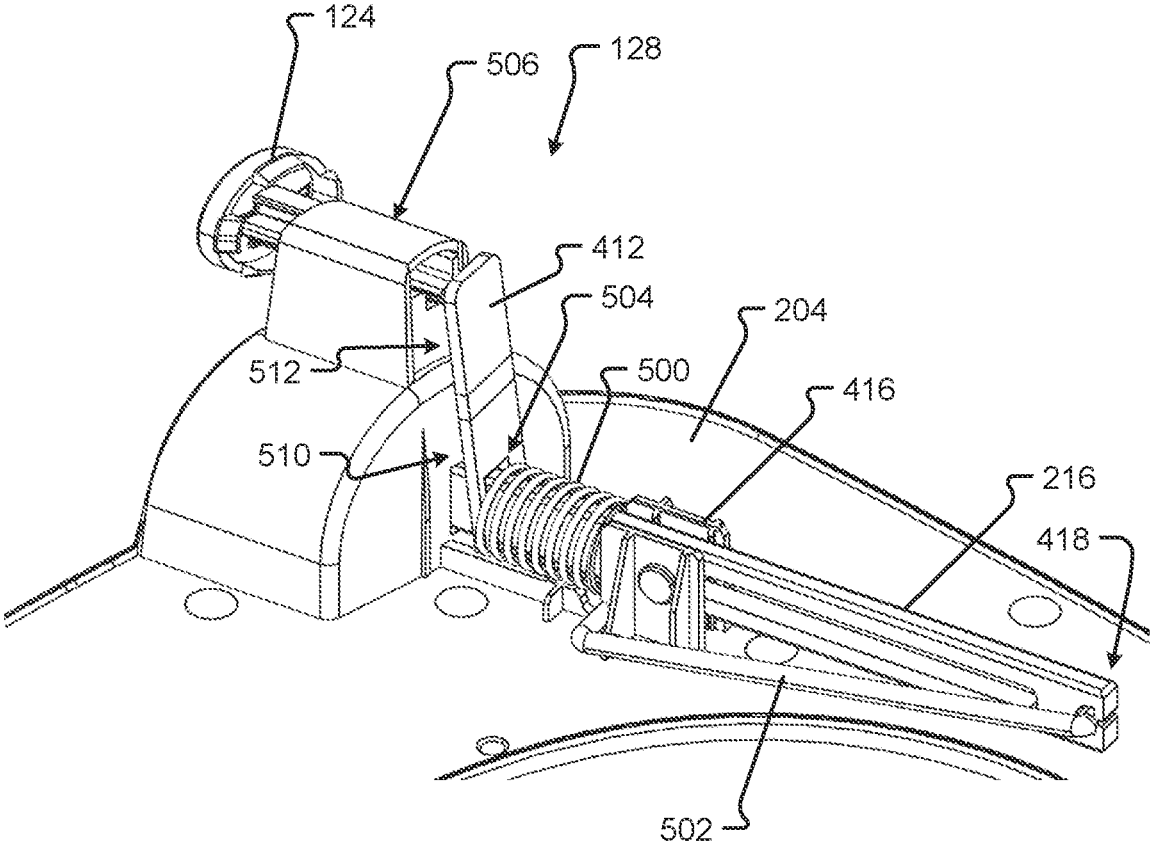
FIG. 5 is a detail perspective view of a portion of an inside of a toilet seat lower body and components attached thereto in accordance with examples of the present disclosure.

The upper sitting surface 108 is shown and described below in a particular configuration (or shown to have a particular configuration or shape), however, it should be appreciated that this is one of many possible configurations or shapes. In some examples, the upper sitting surface 108 of the upper body 104 may be contoured for ergonomic comfort and to reflect a toilet seat of a toilet fixture. In this way, when the toilet seat 100 is positioned on a toilet fixture, the toilet seat 100 may look as if it were always part of the toilet fixture, as shown in FIG. 5.

The upper body 104 and the seat back 112 are shown and described below in a particular configuration (or shown to have a particular configuration or shape), though it should be appreciated that this is one of many possible configurations or shapes. In some examples, the upper sitting surface 108 may be slightly angled or sloped forward from the seat back 112 to the seat front 116, as shown in FIG. 1B. In other words, the height of the toilet seat 100 at the seat back 112 may be greater than the height of the toilet seat 100 at the seat front 116. This angled or sloped configuration may assist users that have a particularly limited range of motion by, for example, guiding the user forward towards the seat front 116 if the user is initially positioned near the seat back 112. Further, the sloped configuration may comprise contouring for increased pelvic comfort for a user.

At least a portion of the seat back 112 may be slightly angled, for example, 20 degrees or less, or substantially flat to abut against a tank or a seat (in the upright position) of a toilet fixture. The seat back 112 may also enable the toilet seat 100 to be stored upright if desired.

Figure 2:
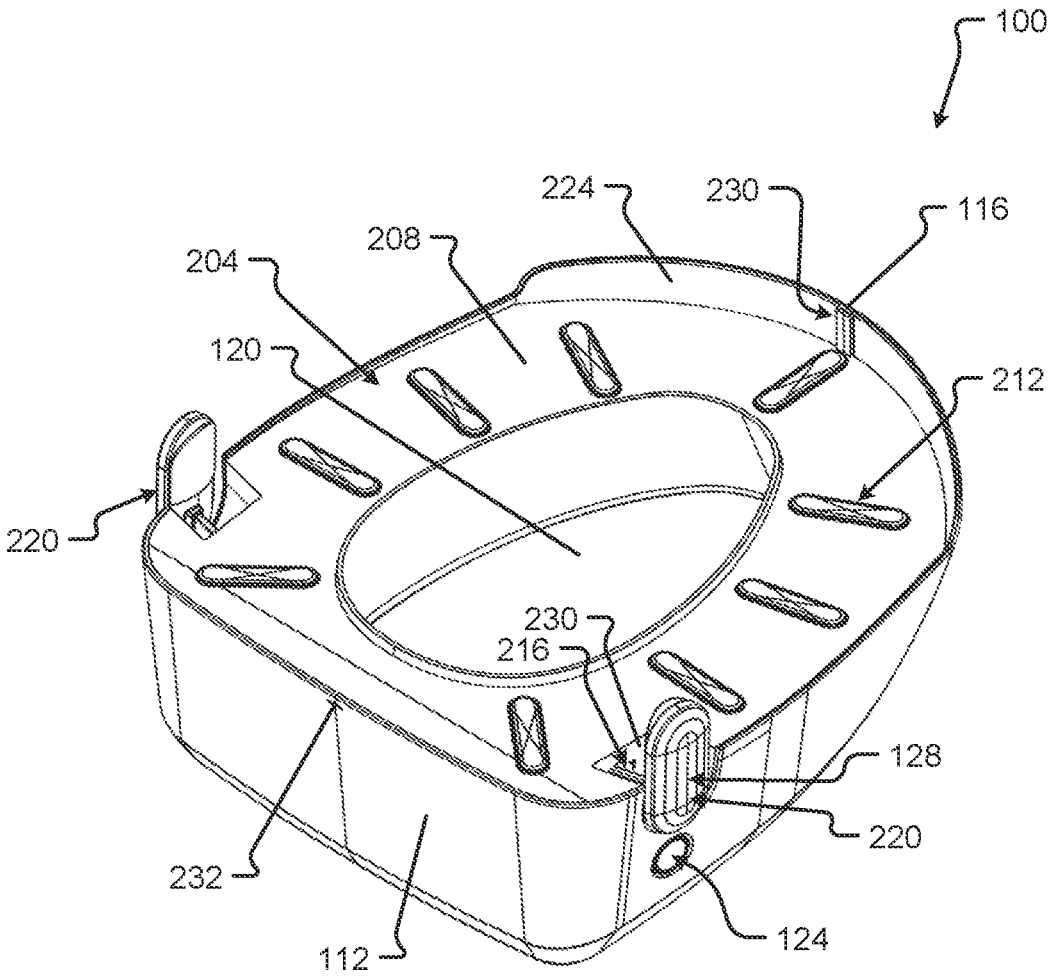
FIG. 2 is a bottom perspective view of a toilet seat in accordance with examples of the present disclosure.

Turning to FIG. 2, a bottom perspective view of the toilet seat 100 is shown. In the illustrated example, the toilet seat 100 includes the upper body 104 connected to or mated with a lower body 204. The upper body 104 and lower body 204 may both include a hole or opening 120 therein that match an opening of a traditional toilet fixture. The hole or opening 120 may be circular, rounded, or elongated. The upper body 104 is shown to include a front lip 224 (also shown in FIG. 1B) that extends beyond the lower body 204. Though the front lip 224 is described and shown in a particular configuration (or shown to have a particular configuration or shape), it should be appreciated that this is one of many possible configurations or shapes. The front lip 224 may be configured to provide a point of contact with the toilet fixture when the toilet seat 100 is placed on the toilet fixture (e.g., to prevent the toilet seat 100 from sliding backwards).

The front lip 224 may be provided with one or more rim pads 230 that help to improve the interface between the front lip 224 and the seat of the toilet fixture. The rim pads 230 may protrude or extend from the front lip 224. In other instances, the rim pads 230 may be substantially in-line with the front lip 224. The rim pads 230 may include one or multiple non-slip pads of material that grip and maintain placement on a porcelain or hard plastic surface. The rim pads 230 may be constructed of silicone and/or Thermoplastic Elastomers (TPE). In some examples, the rim pads 230 may be integral or co-molded with the front lip 224. In some examples, the rim pads 230 may be used to cover hardware/connectors or, for example, a seam of the front lip 224.

As previously described, the upper sitting surface 108 may be a surface upon which a user sits whereas the lower body 204 may interface with a seat of a toilet fixture or the like. Specifically, the lower body 204 may include a lower contact surface 208 that faces toward the toilet fixture in a working position and that contacts the toilet fixture during use. The lower contact surface 208 may be provided with a number of seat grips 212 that help to improve the interface between the lower contact surface 208 and the seat of the toilet fixture. The seat grips 212 may protrude or extend from the lower contact surface 208. In other instances, the seat grips 212 may be substantially in-line with the lower contact surface 208. The seat grips 212 may include one or multiple non-slip pads of material that grip and maintain placement on a porcelain or hard plastic surface. The seat grips 212 may be constructed of silicone and/or Thermoplastic Elastomers (TPE). In some examples, the seat grips 212 may be integral or co-molded with the lower body 204. In some examples, the seat grips 212 may be used to cover hardware/connectors that are used to secure the lower body 204 to the upper body 104.

The connection between the upper body 104 and lower body 204 may be watertight to ensure that no moisture enters a cavity 304 (visible in FIG. 3) formed between the upper body 104 and lower body 204. In some examples, the upper body 104 may be connected to the lower body 204 by one or more of an adhesive, friction welding, snap-fitting, friction-fitting, or the like. It may also be possible to provide the upper body 104 and lower body 204 as a single integral part (e.g., the upper body 104 and lower body 204 may be taken from a common mold or molded from a common material). In other examples, the upper body 104 and lower body 204 may be separate components that fit together and are either detachably connectable or permanently connectable. Providing separate components may facilitate the connection of additional components in-between the upper body 104 and lower body 204 (e.g., within the cavity 304 formed between the upper body 104 and lower body 204).

In some examples, such as illustrated in FIG. 2, the upper body 104 may include a weep hole 232 open to the cavity 304 and an environment outside of the toilet seat 100. The weep hole 232 may be used to empty the cavity 304 of any liquid or fluid that may have inadvertently entered the cavity 304. It will be appreciated that in other examples, the toilet seat 100 may not include the weep hole 232.

The upper body 104 may be formed of a plastic, porcelain, or similar formable material that is strong enough to support a sitting person. In some examples, the toilet seat 100 may be configured to support a person over 300 lbs, which means that the shape and material used for the upper body 104 is designed to support the person over 300 lbs. For example, the lower body 204 may include support bosses or ribbing to increase a strength of the toilet seat 100. The toilet seat 100 may also be sized and shaped to fit a standard toilet fixture of an elongated style toil or a round style toilet, though it will be appreciated that the toilet seat 100 may be sized and shaped to fit any toilet fixture.

An illustrative component or set of components that may be provided between the upper body 104 and the lower body 204 is a clamp 128 and a release button 124. The toilet seat 100 is shown to include two clamps 128, but it should be appreciated that a toilet seat 100 may include a greater or lesser number of clamps 128 without departing from the scope of the present disclosure. The clamp(s) 128 may be configured to secure the interface between the toilet seat 100 and a toilet fixture or other sitting surface. The clamps(s) 128 enable the toilet seat 100 to be easily installed and installed without the use of tools.

The clamp(s) 128 may be configured to move between a first position and a second position. In some examples, the clamp(s) 128 may be configured to slide or move laterally between the first position and second position. More specifically, the clamp(s) 128 may be configured to fully extend or expand to the first position where the clamp is fully extended away from the upper body 104 (shown in, for example, FIG. 4). The clamp(s) 128 may also be configured to grip a toilet fixture or fit within a clamp arm housing 288 when in a second, retracted, position (shown in, for example, FIG. 1A). The clamp(s) 128 may be selectively moveable between an infinite number of additional positions between the first position and the second position.

In other examples, the clamp(s) 128 may be configured to move and index to a fixed and determinable number of positions between the first position and the second position. In this latter configuration, the clamp(s) 128 may be provided with one or more detents that enable the clamp(s) 128 to index between a fixed number of determinable positions.

Figure 3:
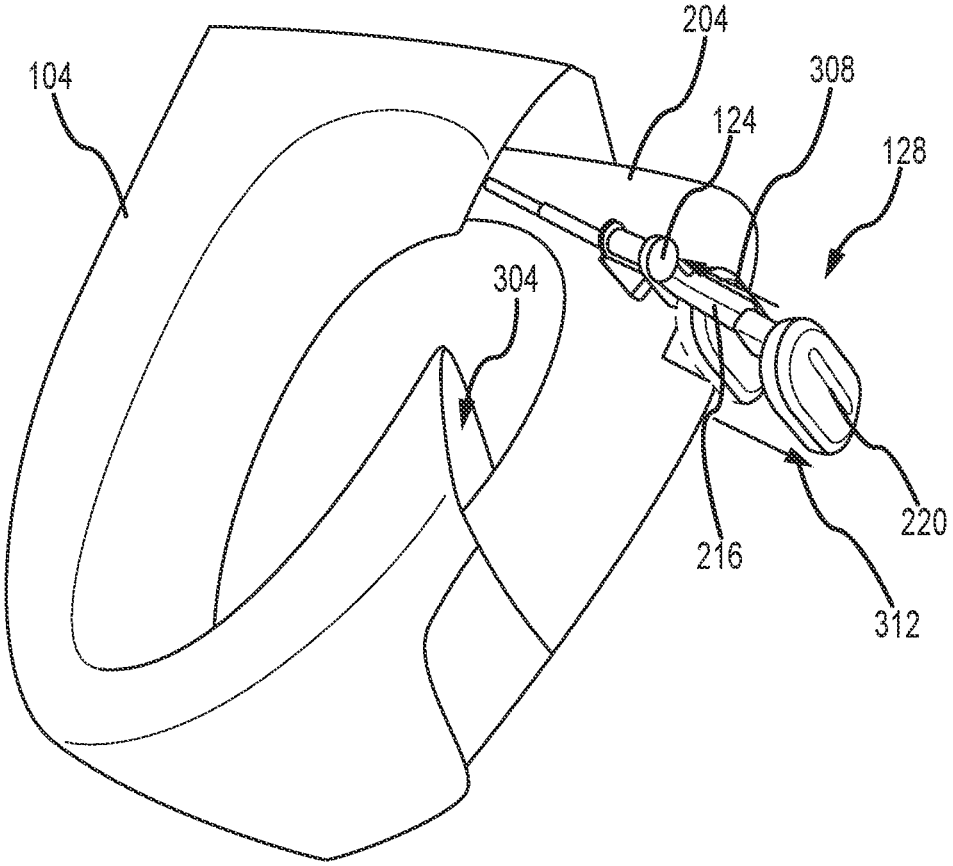
FIG. 3 is a cut-away perspective view of a toilet seat in accordance with examples of the present disclosure.

Turning to FIG. 3, a cut-away perspective view of the toilet seat 100 is shown. As illustrated, each clamp 128 may be provided with a clamp arm 216, a clamp paddle 220, and a number of other components that enable the clamp arm 216 to slide between the first position (e.g., the extended position) and the second position (e.g., the retracted position). It should be appreciated that the second position may correspond to a position in which the toilet seat 100 is resting upon a toilet fixture and/or a position where the clamp paddle 220 is housed within a clamp arm housing 230. In some examples, the second position may correspond to a position where the clamp arm 216 is more than half contained within the cavity 304 formed between the upper body 104 and lower body 204. In other examples, the second position may correspond to a position where the clamp paddle(s) 220 are pressed against the toilet fixture to secure or fix the toilet seat 100 to the toilet fixture.

Enabling the clamp arm 216 to extend between a number of different positions allows the toilet seat 100 to be used with a number of differently sized toilet fixtures and sitting surfaces. That is to say, the toilet seat 100 may be highly adaptable to a number of different toilet fixtures because the clamp paddles 220 can extend beyond the sidewalls 132 of the upper body 104 and inside the sidewalls 132 of the upper body 104.

Figure 4:
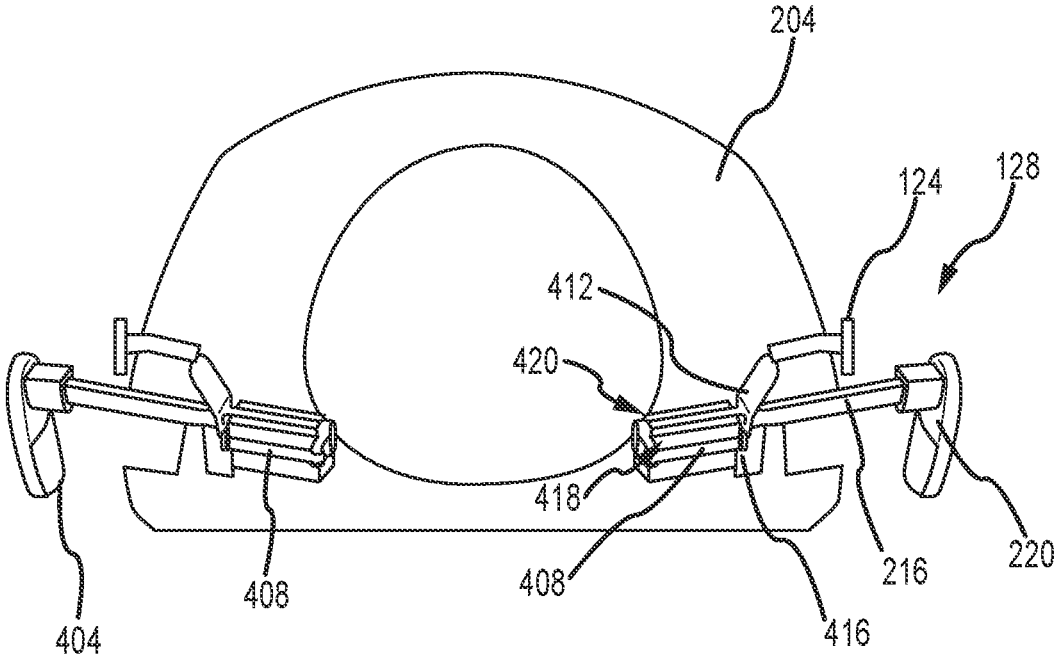
FIG. 4 is a perspective view of an inside of a toilet seat lower body and components attached thereto in accordance with examples of the present disclosure.

Turning to FIGS. 4 and 5, a perspective view of the lower body 204 and components of the clamp 128 attached thereto is shown in each Figure. The clamp paddle 220 is shown to be coupled to the clamp arm 216, which means that movement of the clamp arm 216 translates to movement of the clamp paddle 220. The clamp arm 216 may be connected to the lower body 204 by a support or mount 416, which provides a physical support for the clamp arm 216 as well as a translation pathway that enables lateral/sliding movement of the clamp arm 216 through the mount 416. The mount 416 may include a rail 420 which supports and guides the clamp arm 216 along the translational pathway.

The mount 416 may also support an extension spring 408 (shown in FIG. 4) or a bungee cord 502 (shown in FIG. 5) and a lever 412 which cooperate with one another to limit motion of the clamp 128 when appropriate and to facilitate/automatically initiate motion of the clamp 128 when appropriate. The extension spring 408 may be formed as an elastic band, a metal helical extension spring, and/or any other resilient, flexible, compliant, and/or elastic material. The extension spring 408 provides a resistance to a pulling force applied to at least one end thereof. While the pulling force may move the extension spring 408 from an unextended state, or an at least partially unextended state, to an extended state, the elastic structure of the extension spring 408 provides a restoring force that acts to maintain the ends of the extension spring 408 in the unextended state. The extension spring 408 or the bungee cord 502 may bias the clamp arm 216 outward or away from the toilet seat 100. More specifically, the extension spring 408 may be coupled to the mount 416 at one end and to an end 418 of the clamp arm 216 at another end such that the extension spring 408 pulls the end of the clamp arm 216 towards the mount 416, thereby biasing the clamp 220 and a portion of the clamp arm 216 away from the toilet seat 100. Similarly, as shown in FIG. 5, the bungee cord 502 (e.g., elastic band, elastic cord, shock cord, etc.) may be coupled to the mount 416 at one end and to the end 418 of the clamp arm 216 at another end such that the bungee cord 502 pulls the end of the clamp arm 216 towards the mount 416, thereby biasing the clamp arm 216 away from the toilet seat 100.

The release button 124 is shown coupled to the lever 412. The lever 412 is supported by a housing 506 and comprises an upper portion 512 and a lower portion 510. The lever 412 also includes a slot 504 disposed in the lower portion 510 and through which the clamp arm 216 extends therethrough. The lever 412 is coupled to the release button 124 at the upper portion 512. A spring 500, shown in FIG. 5, may be disposed between the lower portion 510 of the lever 412 and a portion of the mount 416. The spring 500 may be configured as a compression spring, one or more spring washers/disk springs, other elastic compressive members, and/or combinations thereof. In one example, the spring 500 may provide a force simultaneously against the mount 416 and the lower portion 510 of the lever that prevents the lever 412 from moving or pivoting (e.g., unless actuated by a force applied by the release button). Additionally or alternatively, the spring 500 may bias the upper portion 512 (and thus, the release button 124) of the lever 412 outwardly. When the release button 124 is actuated, or pressed, the lever 412 may pivot at a point adjacent to the spring 500 against a force of the spring 500 that is acting against the lever 412. This actuation may disengage the lever 412 from the clamp arm 216. For instance, disengaging the lever 412 may include moving an edge of the slot 504 in the lever 412 from a holding position (e.g., in line contact with the clamp arm 216 preventing movement of the clamp arm 216 relative to the lever 412), to a sliding position (e.g., where the edge of the slot 504 is out of contact with the clamp arm allowing movement of the clamp arm 216 relative to the lever 412, etc.). Stated another way, the clamp arm 216 may slide through the slot 504 provided in the lever 412 and the spring 500 may bias the lever 412 such that when the clamp arm 216 is pushed inwardly (e.g., when the clamp paddle 220 is pushed toward the lower body 204) the lever 412 allows the clamp arm 216 to move through its slot 504 without substantially inhibiting the sliding motion. Pushing the clamp arm 216 inwardly may compress the extension spring 408 such that an outward force is exerted on the clamp arm 216 by the extension spring 408; however, when the clamp arm 216 is no longer being pushed, the lever 412 catches and stops the clamp arm 216 from extending completely outwardly in response to the outward force applied thereto by the extension spring 408. More specifically, the bias of the lever 412 causes the lever 412 to rotate the slot 504 inwardly (e.g., toward the mount 416) until an edge of the slot 504 contacts the clamp arm 216 and holds the edge of slot 504 against the clamp arm 216. This creates a friction press between the edge of the slot 504 and the clamp arm 216, which holds and locks the clamp arm 216 in place. Thus, the lever 412 may function as an "auto-lock" and retains the clamp 128 in some position other than the first, extended, position even though outward forces are being applied to the clamp arm 216 by the extension spring 408.

In some examples, the clamp arm 216 may include a series of ridges disposed along a length of the clamp arm 216, and the lever 412 may interact with the series of ridges in a ratcheting manner. In some examples, the series of ridges may extend along an entire length of the clamp arm 216 and in other embodiments, the series of ridges may extend along a portion of the length of the clamp arm 216. Further, in still other examples, the series of ridges may extend along a length of the clamp arm 216 on a first side of the clamp arm 216 and a second side of the clamp arm 216. In some examples, the series of ridges may aid in locking the lever 412 and the clamp arm 216 in place. For instance, the edge of the slot 504 may rest between two adjacent ridges.

Contact between the lever 412 and clamp arm 216 may be temporarily released when a user engages/pushes the release button 124. As shown in FIG. 3, when the release button 124 is pressed inward with a release motion 308, the force exerted on the release button 124 is translated to the lever 412, thereby causing the lever 412 to move inward. This motion of the lever 412 may cause the slot 504 in the lever 412 to pivot and lose contact with the clamp arm 216. More specifically, in some examples, actuation of the release button 124 causes the upper portion 512 of the lever 412 to move inward, which moves the lower portion 510 of the lever 412 outwardly (e.g., away from the mount 416). This motion pivots the slot 504 so that the slot 504 moves towards a parallel position with the clamp arm 216, which releases the contact between the lever 412 and the clamp arm 216. With the release button 124 depressed and the lever 412 moved inward, the clamp arm 216 may move outwardly under a spring-induced motion 312. In the absence of outside forces, the clamp arm 216 may fully extend in response to forces applied by the extension spring 408 until the clamp arm 216 has reached its full range of motion. At the extended position, the clamp paddle 220 may be fully extended away from the lower body 204, which makes placement of the toilet seat 100 over a toilet fixture relatively easy and convenient.

It will be appreciated that though the release button 124 is described using a spring 500 to bias the lower portion 510 inwardly towards the mount 416, that the release button 124 may use a spring (not shown) to bias the upper portion 512 of the lever 412 outwardly, thereby biasing the lower portion 510 inwardly. Further, other examples of the release button 124 may bias the upper portion 512 and the lower portion 510 (e.g., the entire lever 412) in the same direction.

During use, once the toilet seat 100 is placed over the toilet fixture, the clamp 128 may be pressed inward (e.g., an inward force may be applied to the clamp paddle 220 to push the clamp arm 216 into the mount 416). Pressure applied to the clamp 128 may cause the clamp paddle 220 to move inward until it contacts the toilet fixture, seat, or the like, and automatically lock, as described above. The rounded shape of the clamp paddle 220 may provide a number of possible contact surfaces for the clamp paddle 220 to contact the toilet fixture. Specifically, the clamp paddle 220 may be provided with a clamp pad 404 that provides a non-slip grip for the clamp paddle 220. The clamp pad 404 may be rounded like the clamp paddle 220 to provide a number of possible contact surfaces. Illustratively, the clamp pad 404 may be constructed of silicone, a Thermoplastic Elastomer (TPE), or any other suitable type of material that can help ensure a tight fit and grip is maintained between the clamp paddle 220 and the toilet fixture.

While an illustrative lever 412, spring 500, extension spring 408, and bungee cord 502 have been described as working components of the clamp 128, it should be appreciated that examples of the present disclosure are not so limited. Rather, the clamp 128 may be constructed of any number of suitable components that provide biasing forces, retention forces, indexing functions, or combinations thereof. For instance, the clamp 128 may include a ratchet assembly, one or more levers, detents on the clamp arm 216, spring-biased index pins, or the like. It should also be appreciated that the lateral/sliding motion of the clamp 128 is but one illustrative path of motion that the clamp 128 may follow. Suitable clamps may also be configured to rotate, pivot, or follow some other non-linear path when moving between a first position and second position.

Figure 6:
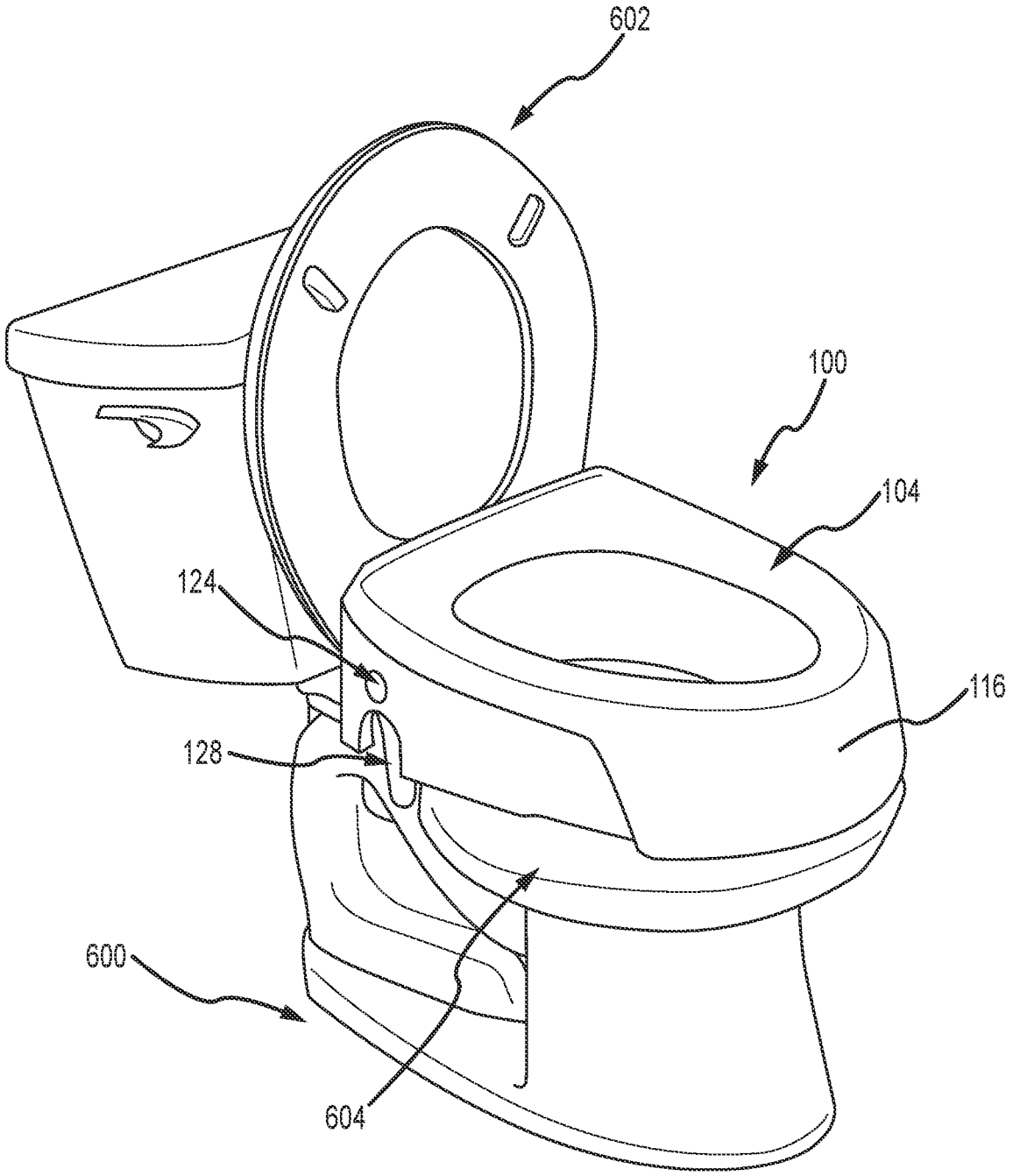
FIG. 6 is a perspective view of a toilet seat mounted to a toilet in accordance with examples of the present disclosure.
Figure 7:
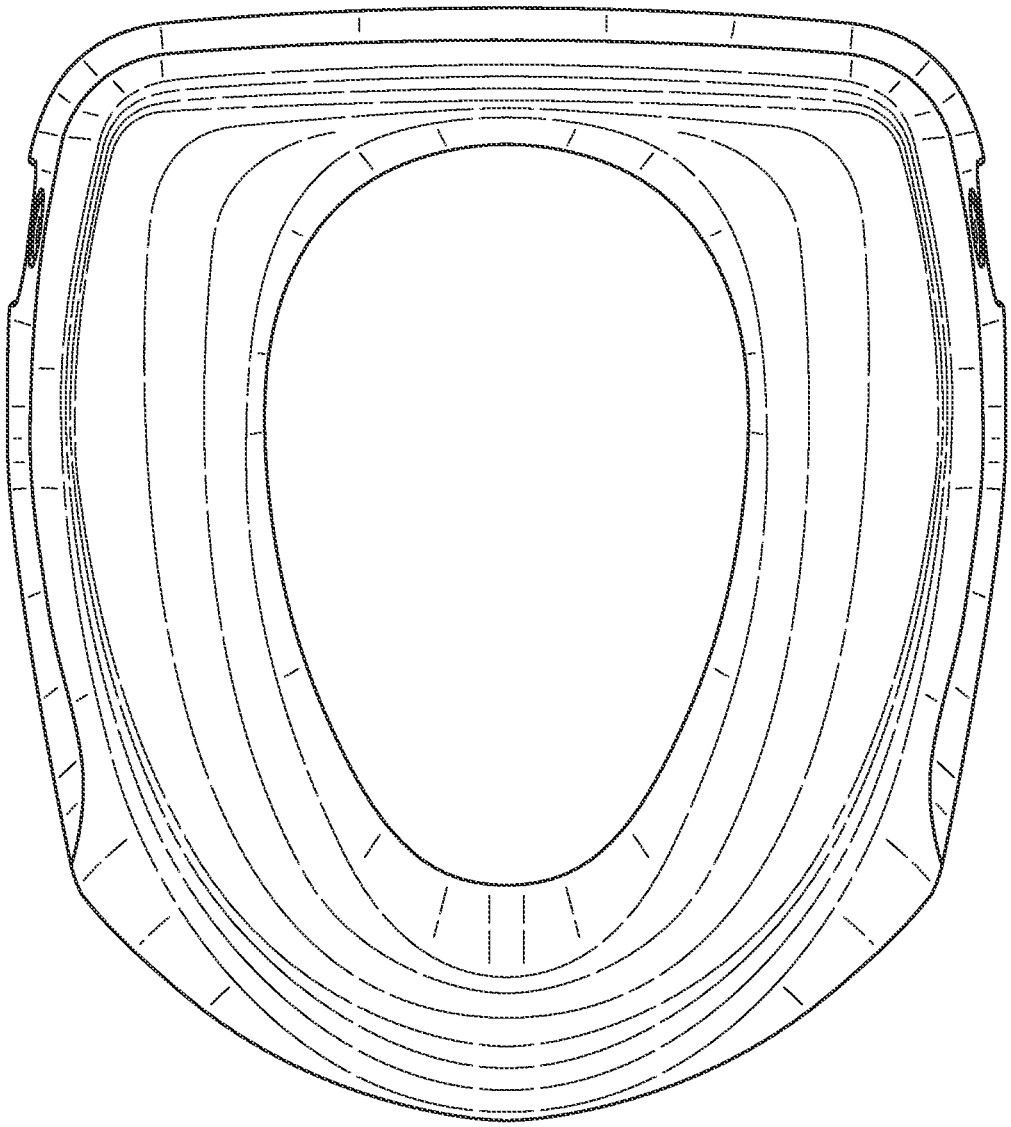
FIG. 7 is a top view of a toilet seat in accordance with examples of the present disclosure.
Figure 8:
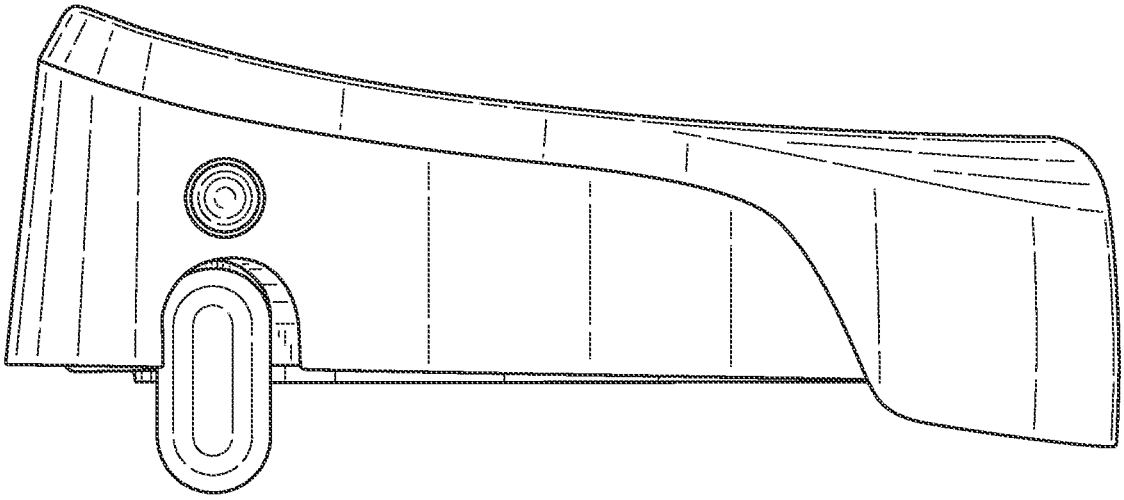
FIG. 8 is a side view of a toilet seat in accordance with examples of the present disclosure.
Figure 9:
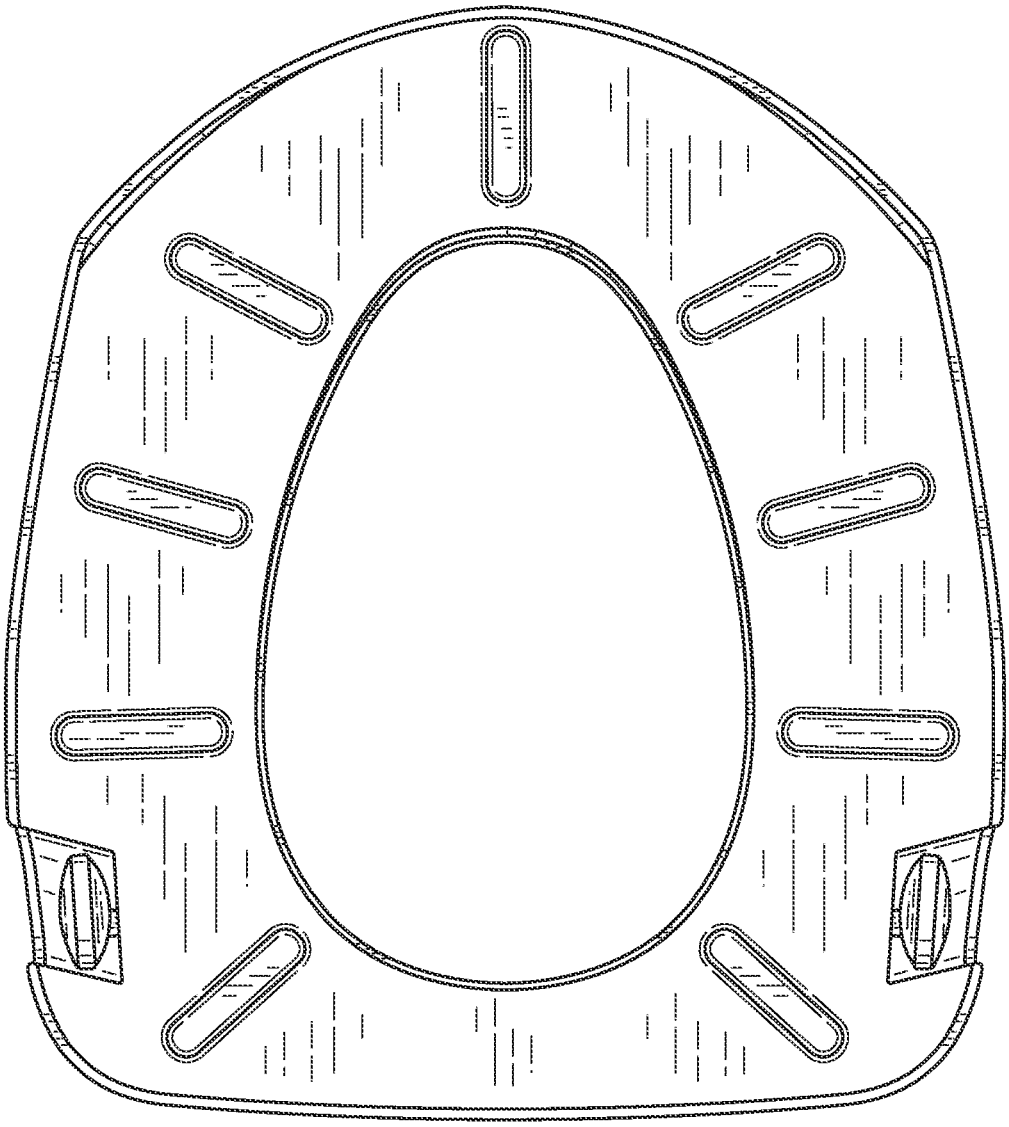
FIG. 9 is a bottom view of a toilet seat in accordance with examples of the present disclosure.
Figure 10:
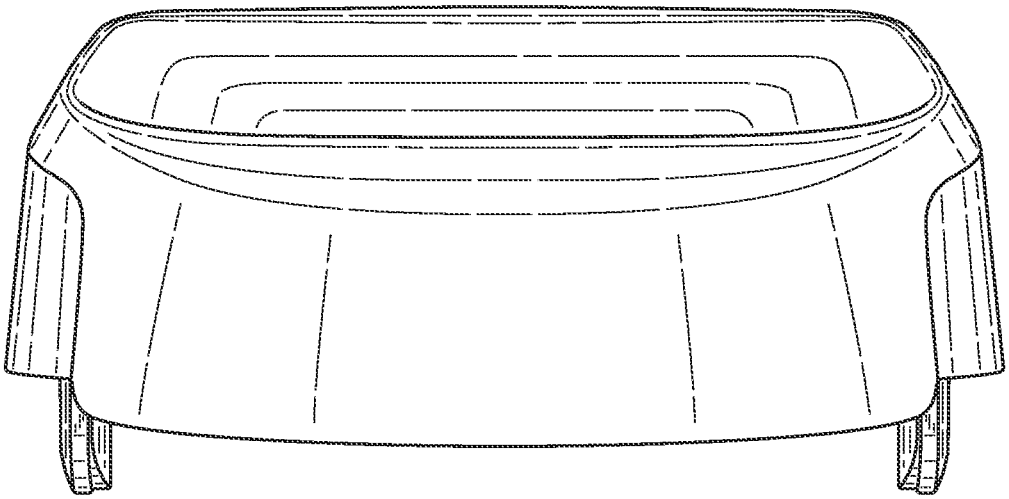
FIG. 10 is a front view of a toilet seat in accordance with examples of the present disclosure.
Figure 11:
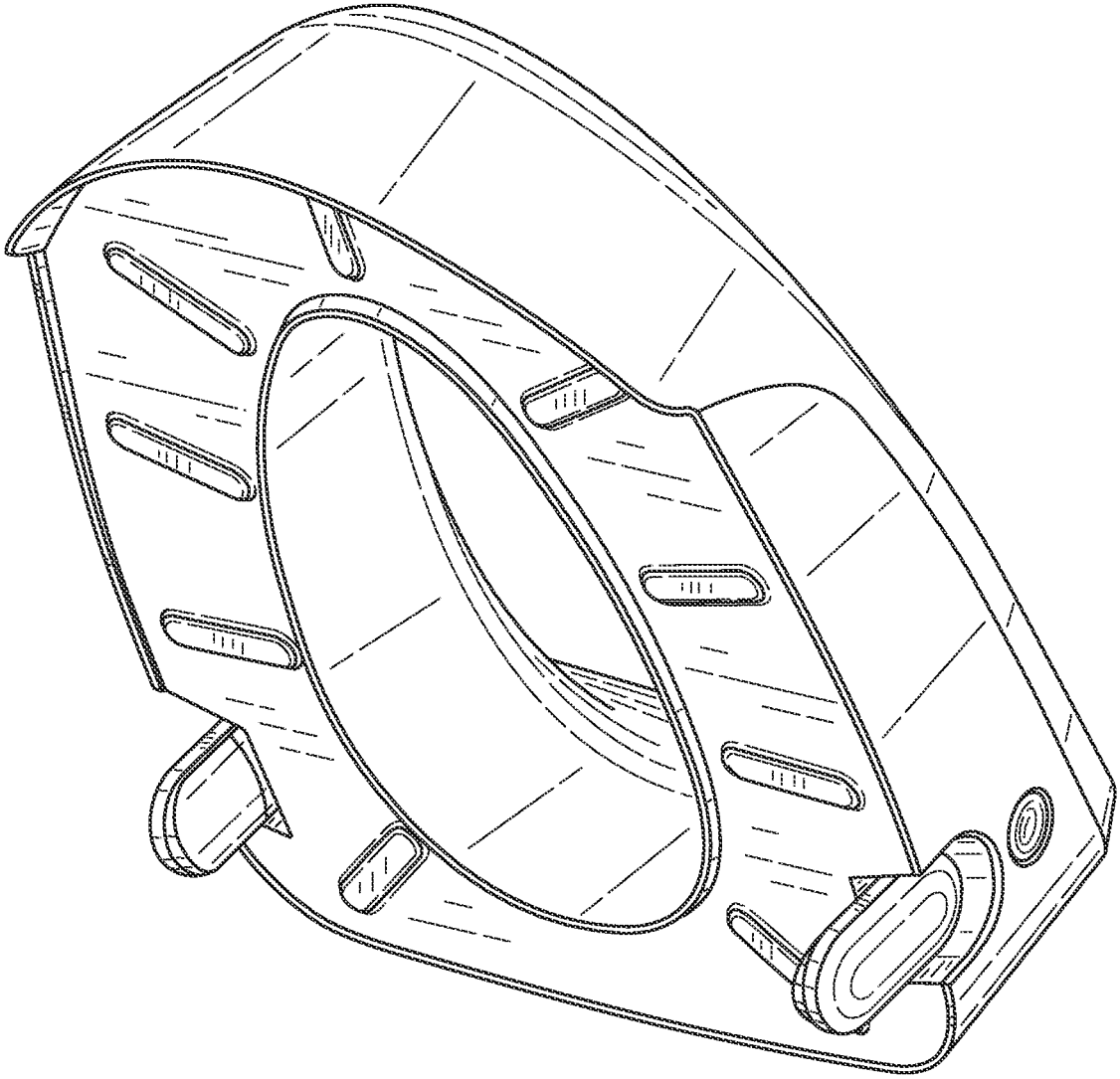
FIG. 11 is a bottom perspective view of a toilet seat in accordance with examples of the present disclosure.
Figure 12:
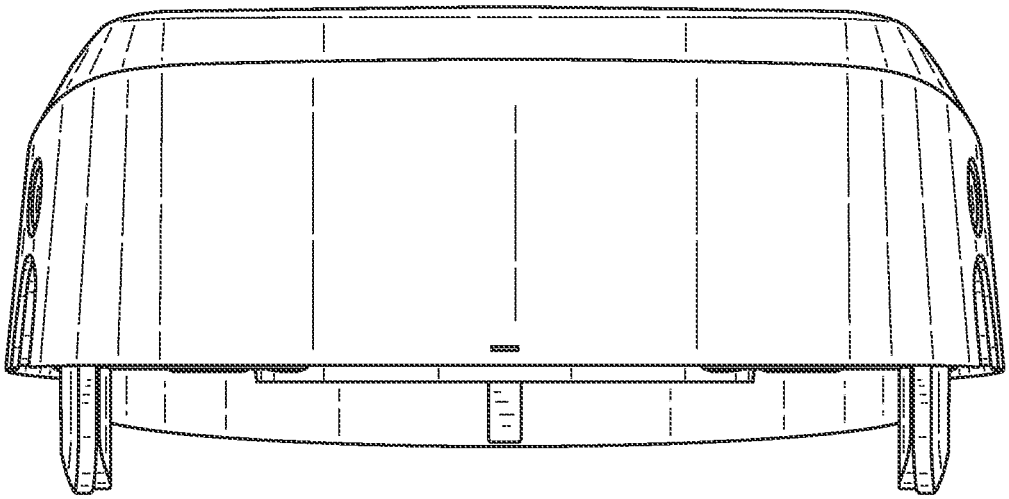
FIG. 12 is a rear view of a toilet seat in accordance with examples of the present disclosure.
Figure 13:
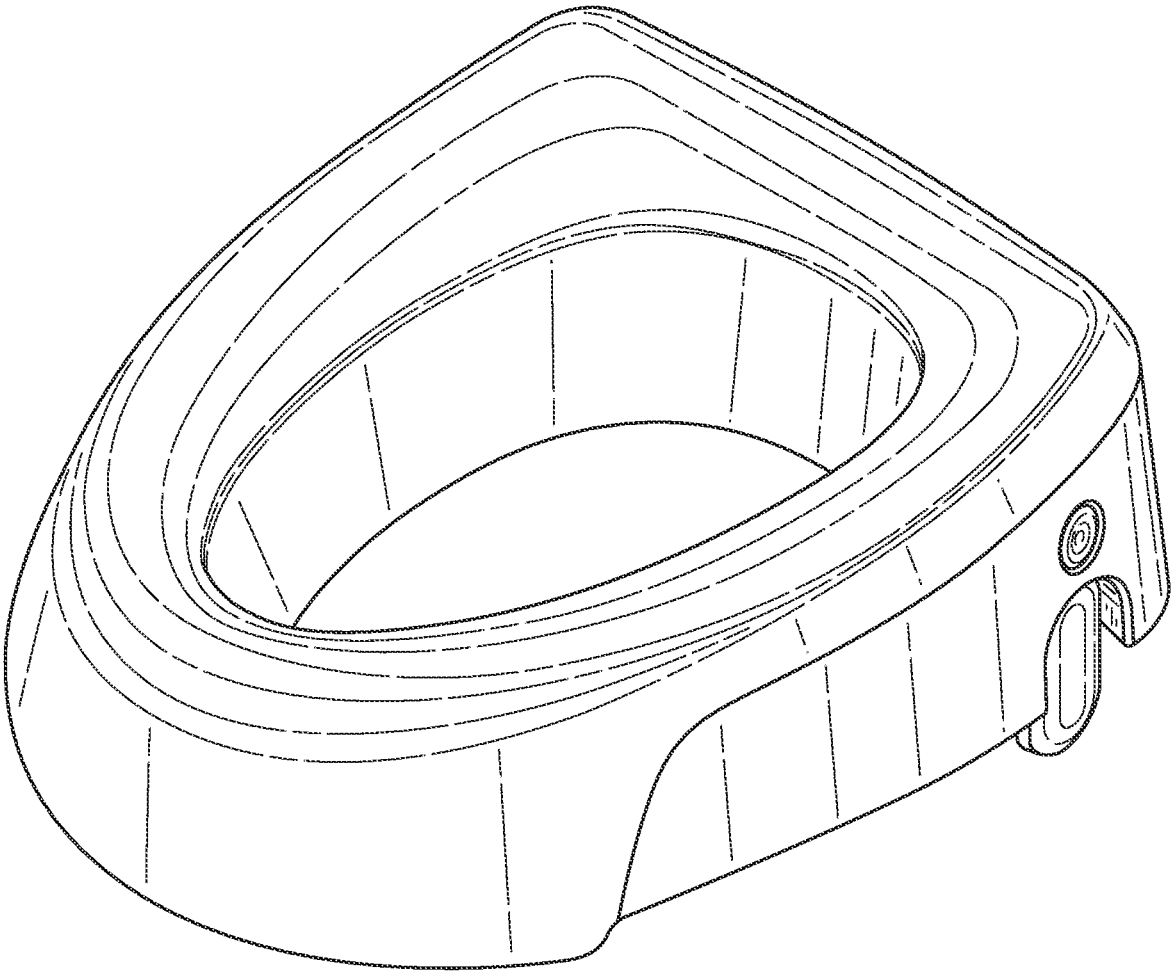
FIG. 13 is a perspective view of a toilet seat in accordance with examples of the present disclosure.

Turning to FIG. 6, the toilet seat 100 fixed to a toilet fixture 600 is shown. As will be described further below, the toilet seat 100 may be installed directly to a bowl 604 of the toilet fixture 600. Prior to or during installation, a toilet lid and seat 602 may be moved to an upright position so that the toilet seat 100 may be installed to the bowl 604.

FIGS. 7-13 show additional views of the toilet seat 100 for illustrative purposes.

Figure 14:
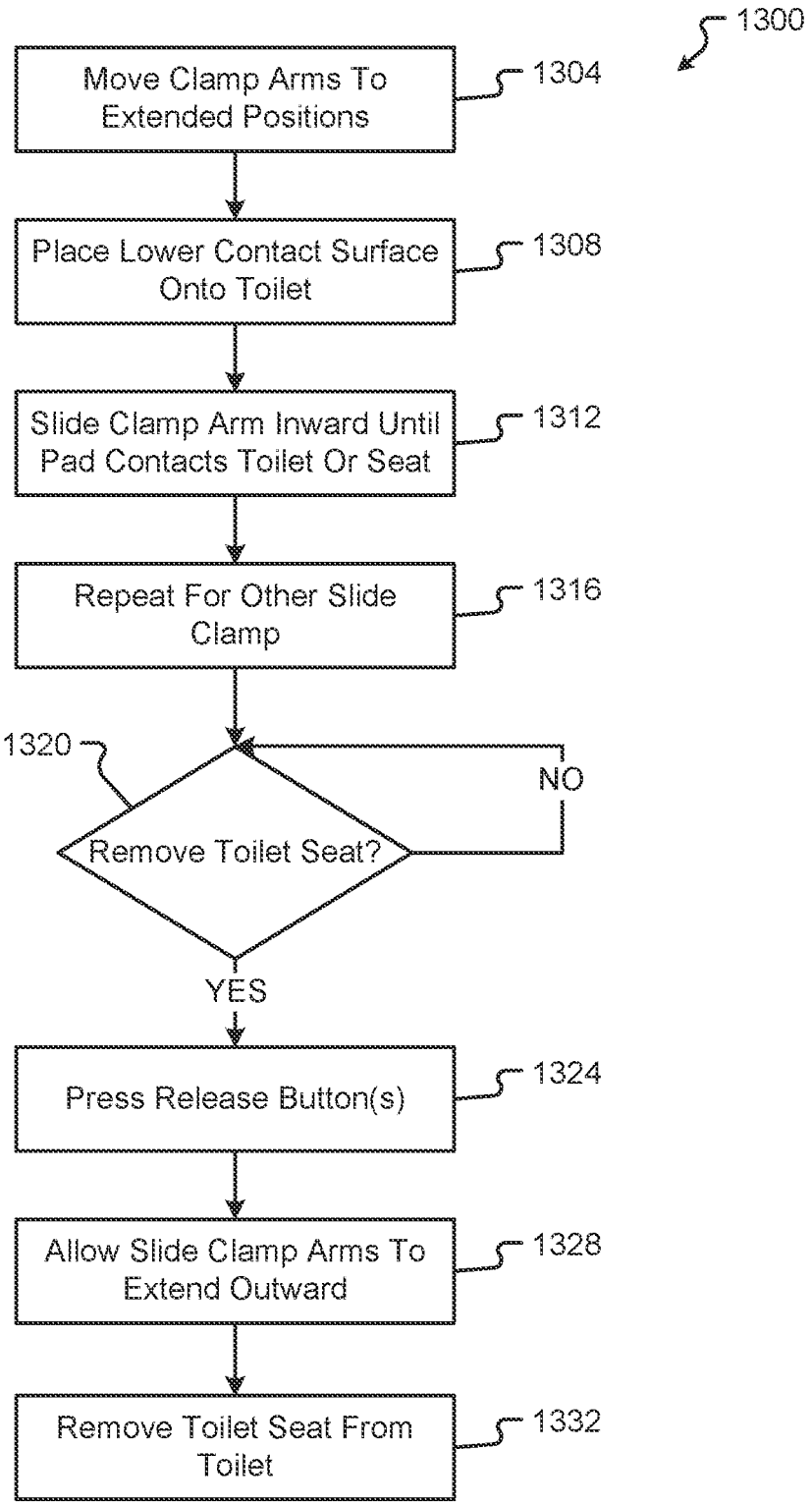
FIG. 14 is a flow diagram depicting a method of using a toilet seat in accordance with examples of the present disclosure.

Referring now to FIG. 14, a method 1300 of using a toilet seat 100 will be described in accordance with at least some examples of the present disclosure. The method 1300 begins when a user moves one or both of the clamp arms 216 into their extended positions (e.g., first positions) (step 1304). The user may extend the clamp arm(s) 216 into their extended positions by pressing the release buttons 124 for each of the clamps 128. Pressing the release buttons 124 may cause the clamp arms 216 to automatically extend in response to an outward force applied by an extension spring 408 or a bungee cord 502.

The user may then place the toilet seat 100 onto a toilet fixture such as the toilet fixture 600 (step 1308). Specifically, the toilet seat 100 may be placed onto the toilet fixture such that the lower contact surface 208 comes into contact with a seat or bowl of the toilet fixture. Once the toilet seat 100 is positioned on the toilet fixture, the method 1300 may continue with the user sliding one or both clamp arms 216 inward until the attached clamp pad 404 contacts the toilet fixture or seat of the toilet fixture (step 1312). The user may slide the clamp arms 216 inward by applying an inward force to the clamp paddle 220, which causes the clamp arm 216 to slide inwardly and compress the extension spring 408. The process of pushing a clamp arm 216 inwardly may be repeated for other clamps 128 or clamp arms 216 (step 1316). Utilization of multiple clamps 128 may enable the user to substantially align the opening 120 with an opening or center of the toilet fixture's bowl.

The toilet seat 100 may then remain in position on the toilet fixture until the user decides to remove the toilet seat 100 (step 1320). When the user decides to remove the toilet seat 100 from the toilet fixture, the user may press a release button 124 to release one clamp arm 216 and allow the associated clamp arm 216 to slide outwardly into an extended position (steps 1324 and 1328). The user may press a single release button 124 to release one or both clamp arms 216. The user may alternatively or additionally press one release button 124 to release one clamp arm 216, then press another release button 124 to release another clamp arm 216.

With one or more clamp arms 216 in an extended position, the user may then be able to remove the toilet seat 100 from the toilet fixture (step 1332). At this point the method 1300 may end, but may be repeated at any appropriate and desirable time in the future.

As should be appreciated by one skilled in the art, aspects of the present disclosure have been illustrated and described herein in any of a number of patentable classes or context including any new and useful process, machine, manufacture, or composition of matter, or any new and useful improvement thereof.

The phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_0$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_0$).

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein.

A number of implementations have been described. Nevertheless, it will be understood that additional modifications may be made without departing from the scope of the inventive concepts described herein, and, accordingly, other examples are within the scope of the following claims.

What is claimed is:

1. A toilet seat, comprising:

an upper body comprising an upper sitting surface;

a lower body coupled with the upper body, wherein the lower body comprises a lower contact surface;

at least one slideable clamp positioned between the upper sitting surface and the lower contact surface, wherein the at least one slideable clamp comprises a clamp arm and a clamp paddle coupled to the clamp arm, and wherein the clamp arm is configured to move between a first position and a second position;

a release button that, when pressed, causes the clamp arm to extend toward the first position; and a lever that couples the release button to the clamp arm and is biased by a retention spring, wherein the lever releases the clamp arm when the release button is pressed such that an extension spring forces the clamp arm to extend toward the first position.

2. The toilet seat of claim 1, wherein the first position corresponds to a position where the clamp arm is extended away from the upper body.

3. The toilet seat of claim 1, wherein the second position corresponds to a position where the clamp arm is more than half contained within a cavity formed between the upper body and the lower body.

4. The toilet seat of claim 1, wherein the clamp paddle contacts a toilet fixture when the clamp arm is in the second position.

5. The toilet seat of claim 1, wherein the clamp paddle comprises a clamp pad and wherein the clamp pad comprises a rounded surface.

6. The toilet seat of claim 5, wherein the clamp pad is manufactured from at least one of silicone or a thermoplastic elastomer.

7. The toilet seat of claim 1, wherein the at least one slideable clamp comprises a first slideable clamp and a second slideable clamp.

8. The toilet seat of claim 7, wherein the first slideable clamp and the second slideable clamp are configured to operate independently.

9. The toilet seat of claim 7, wherein both the first slideable clamp and the second slideable clamp are coupled to the release button.

10. The toilet seat of claim 1, further comprising:

a plurality of seat grips distributed around the lower contact surface.

11. The toilet seat of claim 1, further comprising:

a front lip that extends beyond the lower contact surface of the lower body.

12. The toilet seat of claim 1, wherein the clamp arm includes a series of ridges disposed along at least a portion of a length of the clamp arm and the lever interacts with the series of ridges to aid in locking the lever and the clamp arm in place.

13. A toilet seat comprising:

an upper body comprising an upper sitting surface, a seat back, and a seat front, wherein the seat front has a height less than a height of the seat back;

a lower body coupled with the upper body, wherein the lower body comprises a lower contact surface;

one or more sidewalls extending between the upper body and the lower body;

at least one slideable clamp positioned on the one or more sidewalls, wherein the at least one slideable clamp comprises a clamp arm and a clamp paddle coupled to the clamp arm, and wherein the clamp arm is configured to move between a first position and a second position;

a mount configured to support the clamp arm;

a release button that, when pressed, causes the clamp arm to extend toward the first position; and a lever that couples the release button to the clamp arm and is biased by a retention spring, wherein the lever releases the clamp arm when the release button is pressed such that an extension spring forces the clamp arm to extend toward the first position.

14. The toilet seat of claim 13, wherein the lever comprises an upper portion, a lower portion, and a slot disposed in the lower portion, the slot configured to receive the clamp arm, the lever coupled to the release button at the upper portion.

15. The toilet seat of claim 14, wherein actuation of the release button causes the slot to rotate, thereby releasing the clamp arm.

16. The toilet seat of claim 13, wherein the first position corresponds to a position where the clamp arm is extended away from the upper body, and wherein the second position corresponds to a position where the clamp arm is more than half contained within a cavity formed between the upper body and the lower body.

17. The toilet seat of claim 16, wherein the at least one slideable clamp is biased to the first position.

18. The toilet seat of claim 13, wherein the clamp paddle comprises a clamp pad, and wherein the clamp pad is manufactured from at least one of silicone or a thermoplastic elastomer.

19. The toilet seat of claim 13, wherein the clamp arm includes a series of ridges disposed along at least a portion of a length of the clamp arm and the lever interacts with the series of ridges to aid in locking the lever and the clamp arm in place.

20. A toilet seat comprising:

an upper body comprising an upper sitting surface, a seat back, and a seat front, wherein the seat front has a height less than a height of the seat back;

a lower body coupled with the upper body, wherein the lower body comprises a lower contact surface;

one or more sidewalls extending between the upper body and the lower body;

at least one slideable clamp positioned on the one or more sidewalls, wherein the at least one slideable clamp comprises a clamp arm and a clamp paddle coupled to the clamp arm, and wherein the clamp arm is configured to move between a first position and a second position;

a release button that, when pressed, causes the clamp arm to extend toward the first position; and a lever comprising a slot, the lever coupled to the release button and the slot receiving the clamp arm, the lever biased by a spring to lock the lever against the clamp arm and to release the clamp arm when the release button is actuated.

* * * * *